US009410305B2

(12) United States Patent
Matsuyama et al.

(10) Patent No.: US 9,410,305 B2
(45) Date of Patent: Aug. 9, 2016

(54) EXCAVATION CONTROL SYSTEM FOR HYDRAULIC EXCAVATOR

(71) Applicant: KOMATSU LTD., Tokyo (JP)

(72) Inventors: Toru Matsuyama, Kanagawa (JP); Yoshiki Kami, Hadano (JP); Shin Kashiwabara, Hiratsuka (JP); Masashi Ichihara, Hiratsuka (JP)

(73) Assignee: KOMATSU LTD., Tokyo (JP)

( * ) Notice: Subject to any disclaimer, the term of this patent is extended or adjusted under 35 U.S.C. 154(b) by 160 days.

(21) Appl. No.: 14/526,895

(22) Filed: Oct. 29, 2014

(65) Prior Publication Data

US 2015/0050110 A1 Feb. 19, 2015

Related U.S. Application Data

(63) Continuation of application No. 14/238,059, filed as application No. PCT/JP2013/057211 on Mar. 14, 2013, now Pat. No. 8,909,439.

(30) Foreign Application Priority Data

Apr. 11, 2012 (JP) ..... 2012-090034

(51) Int. Cl.
*G06F 19/00* (2011.01)
*E02F 3/43* (2006.01)
(Continued)

(52) U.S. Cl.
CPC . *E02F 3/435* (2013.01); *E02F 3/32* (2013.01); *E02F 3/43* (2013.01); *E02F 9/2033* (2013.01); *E02F 9/262* (2013.01); *E02F 9/264* (2013.01)

(58) Field of Classification Search
CPC ..... E02F 3/435; E02F 3/431; E02F 9/2029; E02F 3/46; E02F 9/2025; E02F 9/265; E02F 9/26
USPC ..... 701/50
See application file for complete search history.

(56) References Cited

U.S. PATENT DOCUMENTS 3,648,029 A 3/1972 Ungnadner
4,461,015 A 7/1984 Kulhavy
(Continued)

FOREIGN PATENT DOCUMENTS

CN 1140782 A 1/1997
CN 1153248 A 7/1997
(Continued)

OTHER PUBLICATIONS

The Office Action for the corresponding German application No. 11 2013 000 144.6, issued on Jul. 30, 2015.
(Continued)

*Primary Examiner* — Redhwan k Mawari
(74) *Attorney, Agent, or Firm* — Global IP Counselors, LLP

(57) ABSTRACT

An excavation control system includes a working unit having a bucket, a designed landform data storage part storing designed landform data, a bucket position data generation part that generates bucket position data, a designed surface data generation part, and an excavation limit control part. The designed surface data generation part generates superior and subordinate designed surface data based on the designed landform and bucket position data. The superior designed surface data indicates a superior designed surface corresponding to a position of the bucket. The subordinate designed surface data indicates a first subordinate designed surface linked to the superior designed surface. The designed surface data generation part generates shape data indicating shapes of the superior designed surface and the first subordinate designed surface. The excavation limit control part automatically adjusts a position of the bucket.

7 Claims, 9 Drawing Sheets

(51) Int. Cl.

| | |
|---|---|
| ***E02F 9/20*** | (2006.01) |
| ***E02F 9/26*** | (2006.01) |
| ***E02F 3/32*** | (2006.01) |

(56) References Cited

U.S. PATENT DOCUMENTS

| | | | | |
|---|---|---|---|---|
| 5,631,452 | A * | 5/1997 | Jamieson | B66B 1/3492 187/391 |
| 5,735,065 | A * | 4/1998 | Yamagata | E02F 9/2033 37/348 |
| 5,799,419 | A * | 9/1998 | Seo | B25J 9/1679 37/348 |
| 5,864,060 | A * | 1/1999 | Henderson | E02F 9/2045 342/357.57 |
| 8,768,579 | B2 * | 7/2014 | Taylor | E02F 3/437 414/694 |
| 2003/0004645 | A1 * | 1/2003 | Kochi | G06T 7/0075 702/1 |
| 2008/0282583 | A1 * | 11/2008 | Koellner | E02F 3/304 37/348 |
| 2009/0159302 | A1 * | 6/2009 | Koch | E02F 9/265 172/2 |
| 2011/0221107 | A1 * | 9/2011 | Kashiwabara | F16F 9/363 267/140.13 |
| 2011/0311342 | A1 * | 12/2011 | Montgomery | G01C 21/04 414/685 |
| 2014/0200776 | A1 * | 7/2014 | Matsuyama | E02F 3/435 701/50 |

FOREIGN PATENT DOCUMENTS

| | | | |
|---|---|---|---|
| JP | 2006-265954 | A | 10/2006 |
| JP | 2008-106440 | A | 5/2008 |
| JP | 2009-179968 | A | 8/2009 |
| WO | 95/30059 | A1 | 11/1995 |

OTHER PUBLICATIONS

International Search Report for the corresponding international international application No. PCT/JP2013/057211, issued on Jun. 18, 2013.

The Office Action for the corresponding Chinese application No. 201410641989.4, issued on Apr. 12, 2016.

* cited by examiner

EXCAVATION CONTROL SYSTEM FOR HYDRAULIC EXCAVATOR

CROSS-REFERENCE TO RELATED APPLICATIONS

This application is a continuation of U.S. patent application Ser. No. 14/238,059, filed on Feb. 10, 2014, which is a U.S. National stage application of International Application No. PCT/JP2013/057211, filed on Mar. 14, 2013. This U.S. National stage application claims priority under 35 U.S.C. §119(a) to Japanese Patent Application No. 2012-090034, filed in Japan on Apr. 11, 2012. The entire contents of U.S. patent application Ser. No. 14/238,059 and Japanese Patent Application No. 2012-090034 are hereby incorporated herein by reference.

BACKGROUND

1. Field of the Invention

The present invention relates to an excavation control system for a hydraulic excavator.

2. Background Information

The conventional art proposes, for a construction machine provided with a front device including a bucket, an excavation region limit control that moves the bucket along a boundary face indicating a target shape for an excavation object (for example, refer to International Publication No. WO95/30059).

Further, the conventional art discloses a method for calculating designed surface data in a computer located in a hydraulic excavator, based on dimensions and gradient data sent from a computer located at an office (refer Japanese Patent Laid-open No. 2006-26594).

SUMMARY

However, in the invention disclosed in Japanese Patent Laid-open No. 2006-26594, the computer at the hydraulic excavator side calculates designed surface data regardless of whether or not the bucket of the hydraulic excavator is positioned in a range in which excavation is possible. For this reason the processing load on the computer at the hydraulic excavator side becomes large, moreover there are cases in which the calculated designed surface data must be discarded without being used.

In light of the above described problems, a purpose of the present invention is to provide an excavation control system for a hydraulic excavator capable of simply acquiring the desired designed surface data. A hydraulic excavator excavation control system according to an aspect of the present invention is provided with a vehicle main body, a working unit, a designed landform data storage part, a bucket position data generation part, a designed surface data generation part and an excavation limit control part. The working unit has a boom, an arm and a bucket. The boom is attached to the vehicle main body. The arm is attached to the boom. The bucket is attached to the arm. The designed landform data storage part is configured to store designed landform data indicating a target shape for an excavation object. The bucket position data generation part is configured to generate bucket position data indicating a current position of the bucket. The designed surface data generation part is configured to generate superior designed surface data and subordinate designed surface data based on the designed landform data and the bucket position data. The superior designed surface data indicates a superior designed surface corresponding to a position of the bucket. The subordinate designed surface data indicates a first subordinate designed surface linked to the superior designed surface. The designed surface data generation part is configured to generate shape data indicating shapes of the superior designed surface and the first subordinate designed surface. The excavation limit control part is configured to automatically adjust a position of the bucket in relation to the superior designed surface and the first subordinate designed surface based on the shape data and the bucket position data.

DETAILED DESCRIPTION OF EMBODIMENT(S)

An embodiment of the present invention will now be described with reference to the drawings.

Entire Configuration of the Hydraulic Excavator 100

Figure 1:
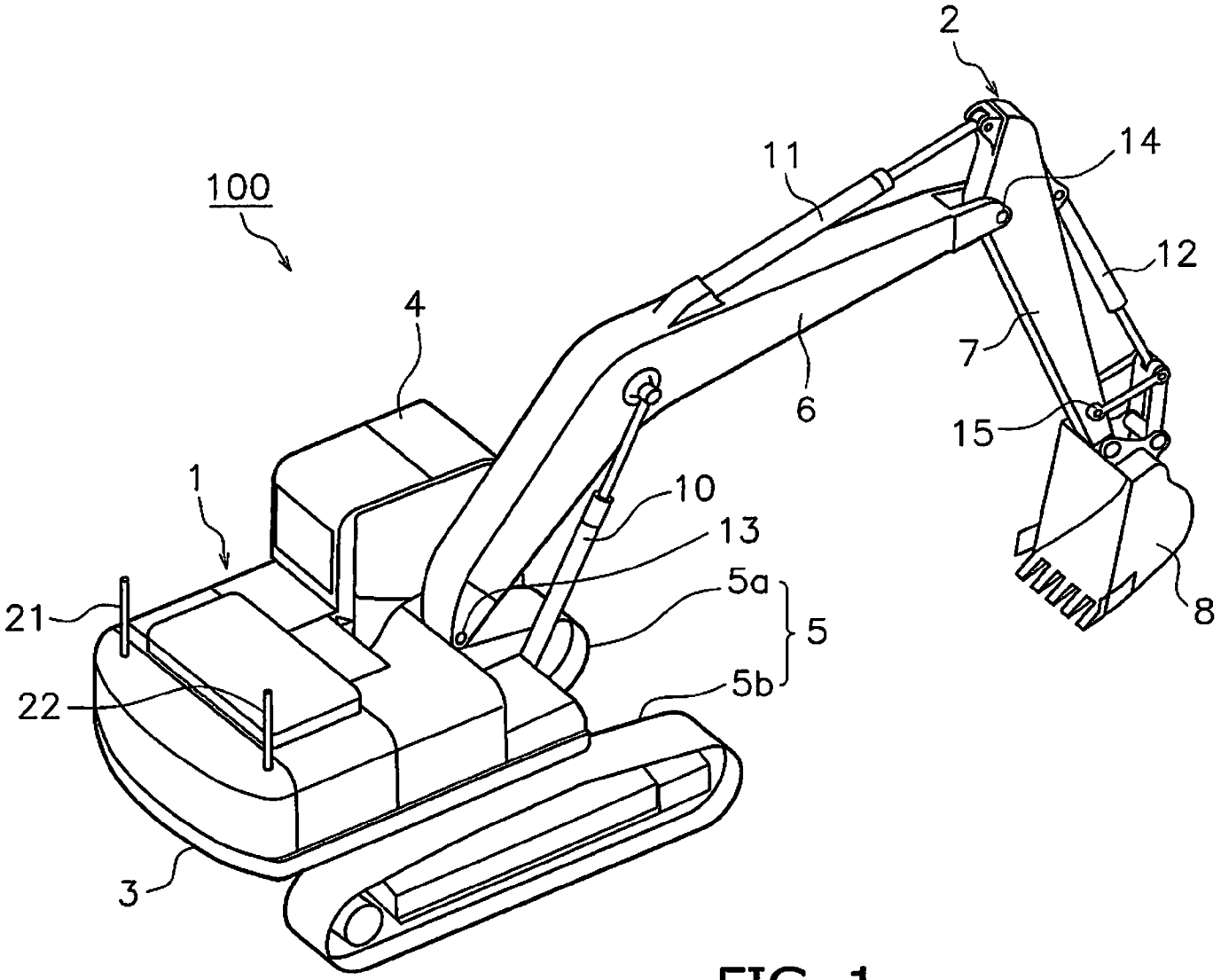
FIG. 1 is a perspective view of the hydraulic excavator.

FIG. 1 is a perspective view of the hydraulic excavator 100 related to this embodiment of the present invention. The hydraulic excavator 100 has a vehicle main body 1, and a working unit 2. Further, an excavation control system 200 is installed to the hydraulic excavator 100. The configuration and operation of the excavation control system 200 is described subsequently.

The vehicle main body 1 has a revolving body 3, a cab 4, and a drive unit 5. The revolving body 3 is arranged above the drive unit 5, and is capable of turning centered around a pivotal axis following the upward-downward direction. The revolving body 3 houses a hydraulic pump and an engine etc., not shown in the drawing.

A first Global Navigation Satellite Systems (GNSS) antenna 21 and a second GNSS antenna 22 are arranged over the rear end portion of the revolving body 3. The first GNSS antenna 21 and the second GNSS antenna 22 are RTK-GNSS (Real-Time Kinematic Global Navigation Satellite Systems, GNSS means satellite systems covering the entire globe) antennas.

The cab 4 is arranged over the front portion of the revolving body 3. Different kinds of operating devices are arranged in the cab 4. The traveling device 5 has a pair of crawler belt 5*a* and 5*b*, and the hydraulic excavator 100 is caused to travel by the rotations of each of the crawler belt 5*a* and 5*b*.

The working unit 2 is installed on the revolving body 3. The working unit 2 has a boom 6, an arm 7, a bucket 8, a boom cylinder 10, an arm cylinder 11, and a bucket cylinder 12.

The base end portion of the boom 6 is attached so as to be capable of swinging, to the front portion of the revolving body 3 via a boom pin 13. The base end portion of the arm 7 is attached, so as to be capable of swinging, to the leading end portion of the boom 6 via an arm pin 14. The bucket 8 is attached, so as to be capable of swinging, at the leading end portion of the arm 7 via a bucket pin 15. The boom cylinder 10, the arm cylinder II, and the bucket cylinder 12 are each driven by hydraulic fluid. The boom cylinder 10 drives the boom 6. The arm cylinder 11 drives the arm 7. The bucket cylinder 12 drives the bucket 8.

Figure 2A:
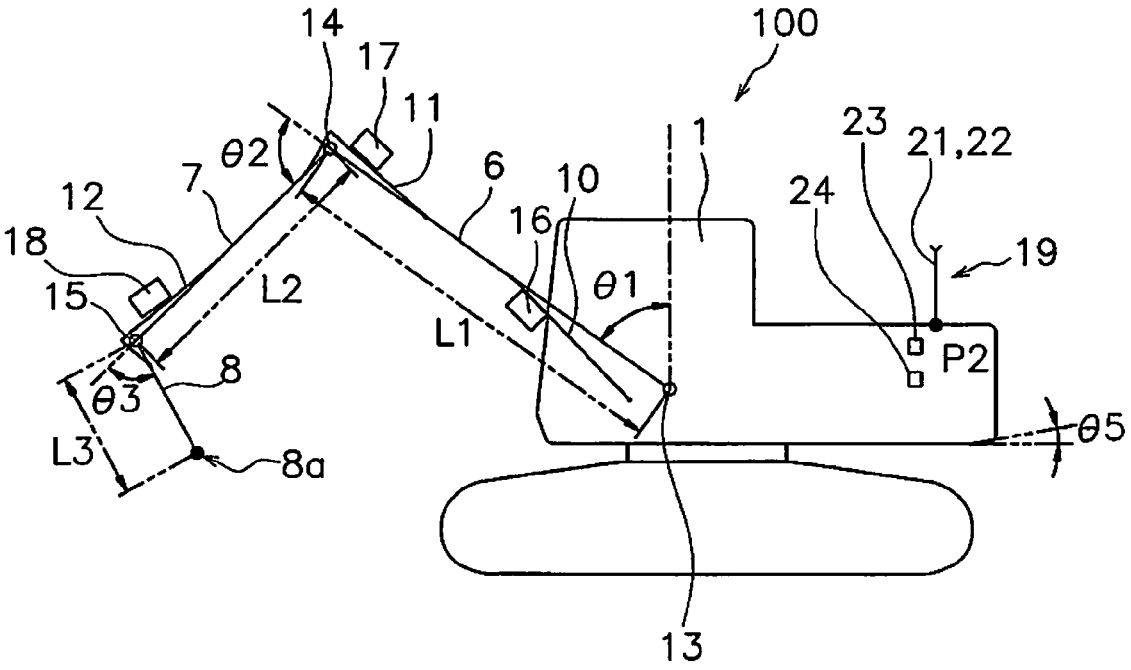
FIG. 2A is a side view of the hydraulic excavator 100.
Figure 2B:
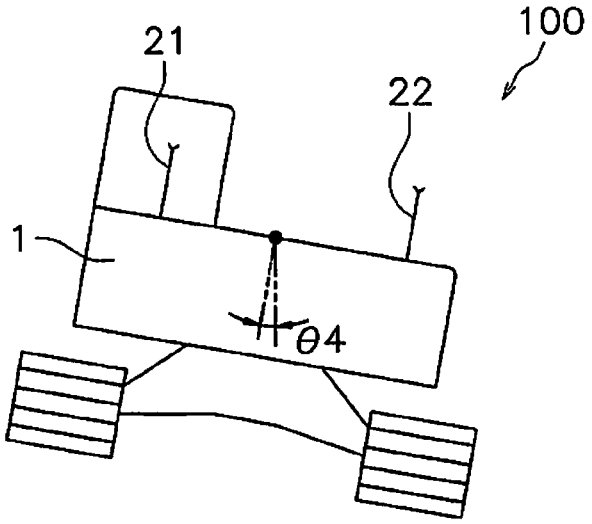
FIG. 2B is a rear view of the hydraulic excavator 100.

Here, FIG. 2A is a side view of the hydraulic excavator 100, and FIG. 2B is a rear view of the shovel 100. As shown in FIG. 2A, the length of the boom 6, that is to say, the length from the boom pin 13 to the arm pin 14 is L1. The length of the arm 7, that is to say, the length from the arm pin 14 to the bucket pin 15 is L2. The length of the bucket 8, that is to say, the length from the bucket pin 15 to the tip end of the tooth of the bucket 8 (hereinafter referred to as "the cutting edge 8*a*"), is L3.

Further, as shown in FIG. 2A, the first, second, and third stroke sensors 16, 17, and 18 are installed to, respectively, the boom cylinder 10, the arm cylinder 11, and the bucket cylinder 12. The first stroke sensor 16 detects the length of the stroke of the boom cylinder 10 (hereinafter referred to as "boom cylinder length N1"). A display controller 28 described subsequently, (refer FIG. 4), calculates the angle of inclination θ1 of the boom 6 in relation to the perpendicular direction of the vehicle main body coordinate system, from the boom cylinder length N1 as detected by the first stroke sensor 16.

The second stroke sensor 17 detects the length of the stroke of the arm cylinder 11 (hereinafter referred to as the "arm cylinder length N2"). The display controller 28 detects the angle of inclination θ2 of the arm 7 in relation to the boom 6 from the arm cylinder length N2 as detected by the second stroke sensor 17.

The third stroke sensor 18 detects the length of the stroke of the bucket cylinder 12 (hereinafter referred to as the "bucket cylinder length N3"). The display controller 28 calculates the angle of inclination θ3 of the cutting edge 8*a* of the bucket 8 in relation to the arm 7 from the bucket cylinder length N3 as detected by the third stroke sensor 18.

As shown in FIG. 2A the vehicle main body 1 is provided with position detection part 19. The position detection part 19 detects the current position of the hydraulic excavator 100. The position detection part 19 has the above described first and second GNSS antennas 21 and 22, a global coordinate computing unit 23, and an Inertial Measurement Unit (IMU).

The first and second GNSS antennas 21 and 22 are mutually separated in the vehicle widthwise direction. A signal coordinated to the GNSS radio waves received by the first and second GNSS antennas 21 and 22 is input to the global coordinate computing unit 23.

The global coordinate computing unit 23 detects the position of the first and second GNSS antennas 21 and 22. The IMU 24 detects the angle of inclination θ4 in the vehicle widthwise direction of the vehicle main body 1 in relation to the direction of gravitational force (the vertical line) (refer FIG. 2B), and the angle of inclination θ5 in the forward-rearward direction of the vehicle main body 1 (refer FIG. 2A).

The global coordinate computing unit 23 updates the current positional information of the first and second GNSS antennas 21 and 22 in connection with the revolutions and movement and the like of the hydraulic excavator 100.

Configuration of the Excavation Control System 200

Figure 3:
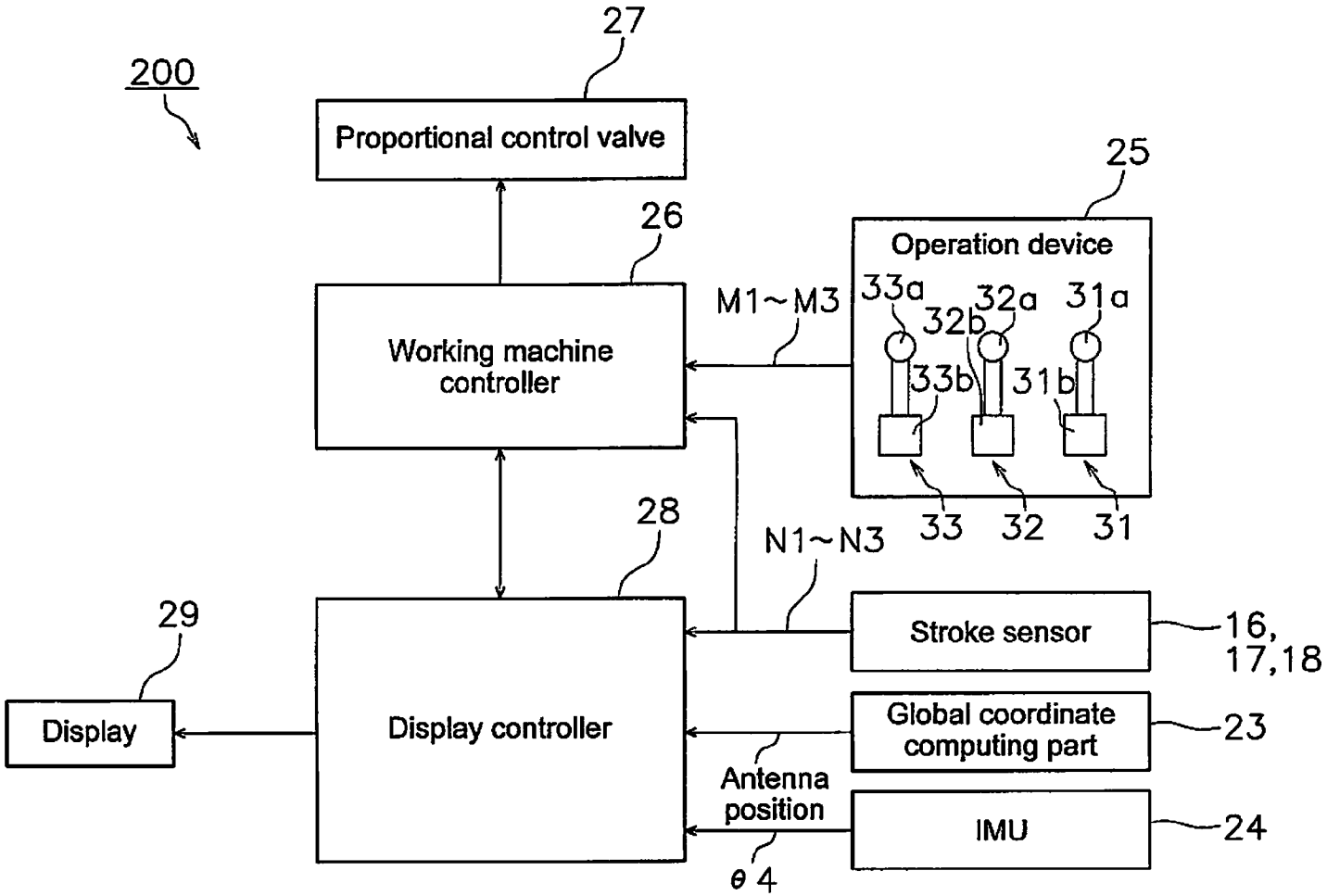
FIG. 3 is a block diagram showing the functional configuration of the excavation control system for the hydraulic excavator.

FIG. 3 is a block diagram showing the functional configuration of the excavation control system 200. The excavation control system 200 is provided with an operating device 25, a working unit controller 26, a proportional control valve 27, a display controller 28, and a display 29.

The operating device 25 receives the operations of the operator driving the working unit 2, and outputs an operation signal in conformance with the operation of the operator. Basically, the operating device 25 has a boom operating tool 31, an arm operating tool 32, and a bucket operating tool 33.

The boom operating tool 31 includes a boom operating lever 31*a*, and boom operation detection part 31*b*. The boom operating lever 31 a receives operation of the boom 6 by the operator. The boom operation detection part 31*b* outputs a boom operation signal M1 in conformance with operation of the boom operating lever 31*a*.

An arm operating lever 32*a* receives operation of the arm 7 by the operator. Arm operation detection part 32*b* outputs an arm operation signal M2 in conformance with operation of the arm operating lever 32*a*.

The bucket operating tool 33 includes a bucket operating lever 33*a*, and bucket operation detection part 33*b*. The bucket operating lever 33*a* receives operation of the bucket 8 by the operator. The bucket operation detection part 33*b* outputs a bucket operation signal M3 in conformance with operation of the bucket operating lever 33*a*.

The working unit controller 26 acquires the boom operation signal M1, the arm operation signal M2, and the bucket operation signal M3 from the operating device 25 (hereinafter these signals being referred to jointly as "operation signals M"). Further, the working unit controller 26 acquires the boom cylinder length N1, the arm cylinder length N2, and the bucket cylinder length N3 from, respectively, the first, second and third stroke sensors, 16, 17 and 18, and based on this information, the working unit controller 26 drives the working unit 2 by outputting control signals to the proportional control valve 27. The function of the working unit controller 26 is described subsequently.

The proportional control valve 27 is arranged between a hydraulic pump (not shown) and the cylinders (the boom cylinder 10, the arm cylinder 11 and the bucket cylinder 12). The proportional control valve 27 supplies hydraulic fluid to each of the boom cylinder 10, the arm cylinder 11, and the bucket cylinder 12, while adjusting the degree of opening of the valve in conformance with a control signal from the working unit controller 26.

The display controller 28 acquires the boom cylinder length N1, the arm cylinder length N2 and the bucket cylinder length N3 from, respectively, the first, second, and third stroke sensors 16, 17 and 18. Further, the display controller 28 acquires the angle of inclination θ4 from the IMU 24, and acquires from the global coordinate computing unit 23, the locations of the first and second GNSS antennas 22 (shown as the antenna location in FIG. 3).

Figure 5:
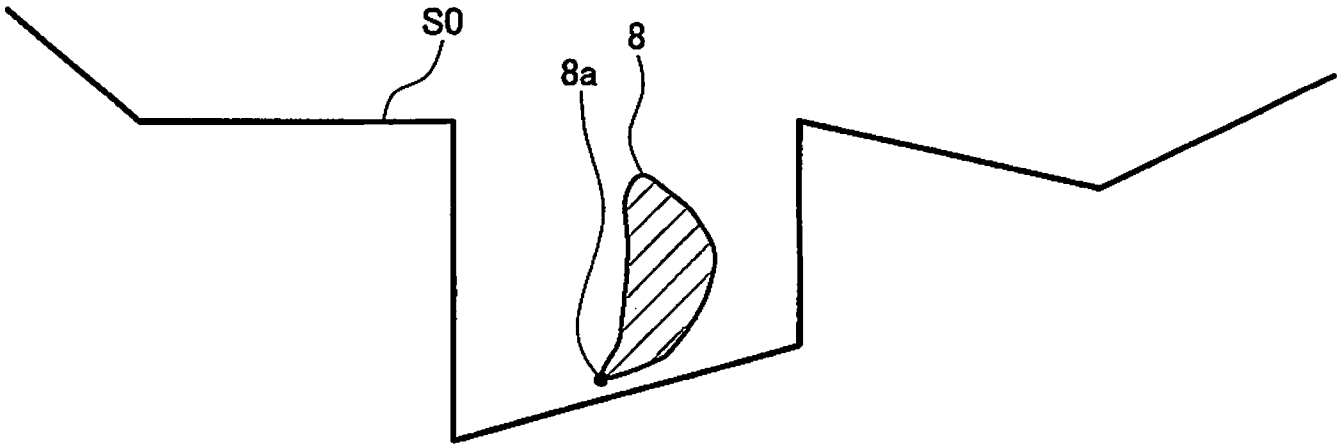
FIG. 5 is a schematic diagram showing a prospective surfaces.
Figure 6:
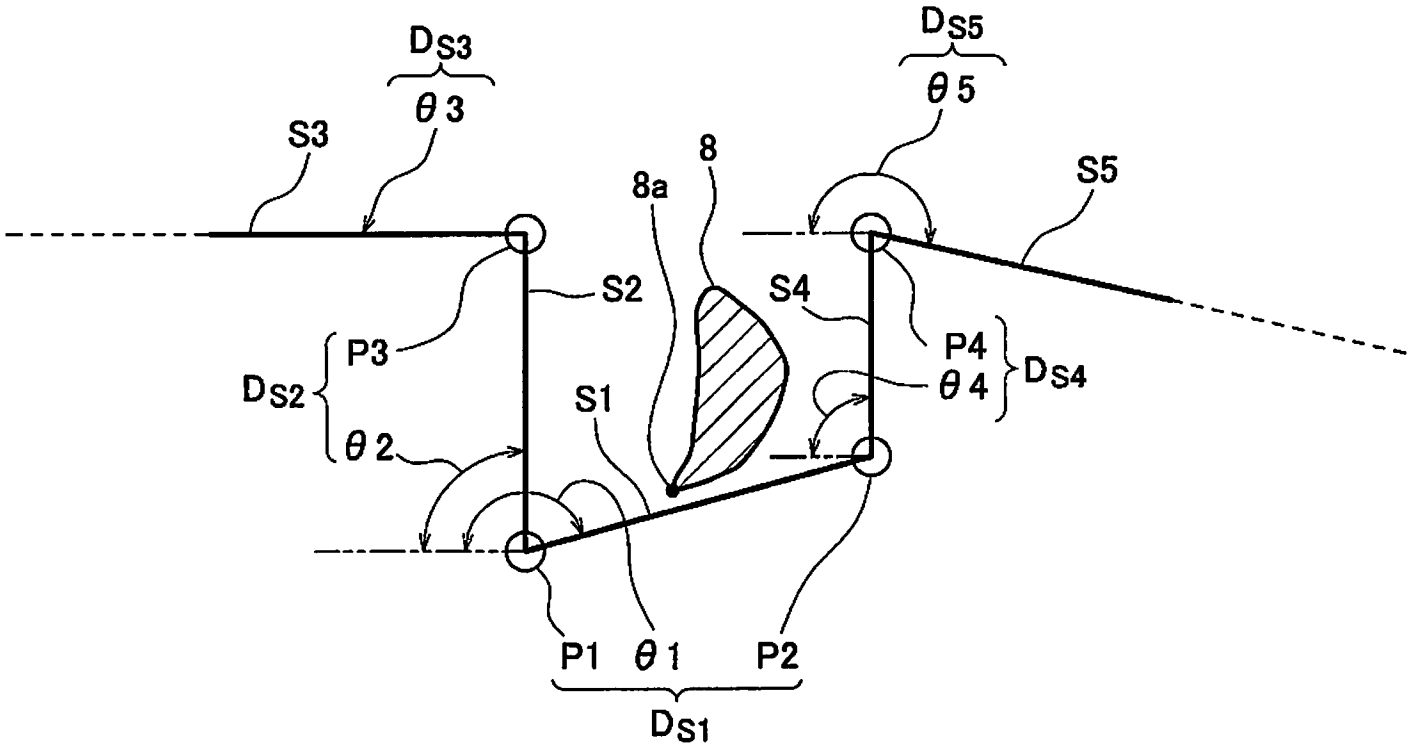
FIG. 6 is a schematic diagram showing designed surfaces.

Then, the display controller 28, based on the current position of the bucket 8 as calculated from this information and the designed landform that is a target shape for an excavation object, generates the described prospective surfaces S0 (refer FIG. 5) and the first through fifth designed surfaces S1-S5 (refer FIG. 6). The display controller 28 causes the prospective surfaces S0 to be displayed on the display 29, and sends the first through fifth designed surfaces S1-S5 to the working unit controller 26. The functions of the display controller 28 are described subsequently.

Configuration of the Display Controller 28

Figure 4:
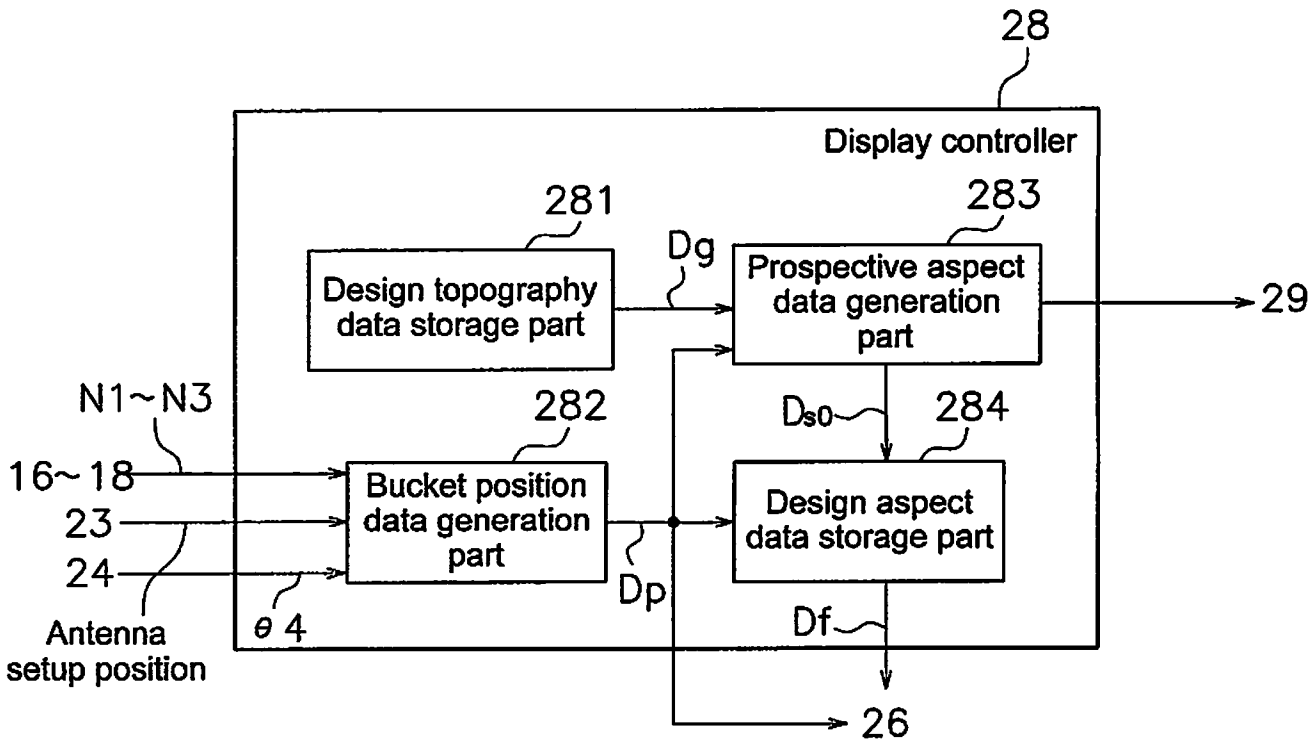
FIG. 4 is a block diagram showing the configuration of the display controller.

FIG. 4 is a block diagram showing the configuration of the display controller 28. FIG. 5 is a schematic diagram showing an example of a prospective surfaces S0, and FIG. 6 is a schematic diagram showing an example of the first through fifth designed surfaces S1-S5.

The display controller 28 is provided with designed landform data storage part 281, bucket position data generation part 282, prospective surfaces data generation part 283, and designed surface data storage part 284.

1. The Designed Landform Data Storage Part 281

The designed landform data storage part 281 stores designed landform data Dg indicating the target shape for the excavation object in the working range (hereinafter referred to as "designed landform"). It is suitable for the designed landform data Dg to include angle data or coordinates data necessary for generating three-dimensional shapes for the first through fifth designed surfaces S1-S5 and the prospective surfaces S0.

2. The Bucket Position Data Generation Part 282

The bucket position data generation part 282 acquires the boom cylinder length N1, the arm cylinder length N2 and the bucket cylinder length N3 from respectively, the first, second, and third stroke sensors 16, 17, and 18, acquires the angle of inclination θ4 from the IMU 24, and acquires the positions of the first and second GNSS antennas 21, 22, from the global coordinate computing unit 23. The bucket position data generation part 282 calculates the angles of inclination θ1-θ3 based on the boom cylinder length N1, the arm cylinder length N2, and the bucket cylinder length N3.

Then, the bucket position data generation part 282 generates bucket position data Dp indicating the current position of the bucket 8, based on the positions of the first and second GNSS antennas 21, 22 and the angles of inclination θ1-θ4. The bucket position data generation part 282 sends the bucket position data Dp thus generated to the working unit controller 26.

Further, the bucket position data generation part 282 intermittently updates the bucket position data Dp, in conformance with the updating of the information indicating the current position of the first and second GNSS antennas 21, 22 from the global coordinate computing unit 23.

3. The Prospective Surfaces Data Generation Part 283

The prospective surfaces data generation part 283 acquires the designed landform data Dg stored in the designed landform data storage part 281, and the bucket position data Dp generated by the bucket position data generation part 282. The prospective surfaces data generation part 283 acquires the designed landform in the vicinity of the bucket indicating the area in the vicinity of the cutting edge 8*a* from among the designed landform, based on the designed landform data Dg and the bucket position data Dp.

Next, the prospective surfaces data generation part 283 determines the prospective surfaces S0 that becomes the prospective designed surface for the intersection of the designed landform in the vicinity of the bucket and the working plane of the working unit 2 (that is to say, the plane passing through the center of the working unit 2 in the vehicle width wise direction), and generates prospective surfaces data $D_{S2}$-$D_{S0}$ indicating the prospective surfaces S0.

The prospective surfaces data generation part 283 sends the prospective surfaces data $D_{S0}$ to the display 29, causing the prospective surfaces S0 to be displayed to the operator. Further, the prospective surfaces data generation part 283 sends the prospective surfaces data $D_{S0}$ to the designed surface data storage part 284.

Note that the prospective surfaces data generation part 283 intermittently updates the prospective surfaces data $D_{S0}$, in conformance with the updating of the bucket position data Dp from the bucket position data generation part 282.

4. The Designed Surface Data Storage Part 284

The designed surface data storage part 284 requires the bucket position data Dp generated by the bucket position data generation part 282, and the prospective surfaces data $D_{S0}$ generated by the prospective surfaces data generation part 283.

The designed surface data storage part 284, as shown in FIG. 6, determines the surface to which the bucket 8 is closest as the first designed surface S1 from among the prospective surfaces S0, based on the bucket position data Dp and the prospective surfaces data $D_{S0}$, and generates the first designed surface data $D_{S1}$ indicating the first designed surface S1.

Further, the designed surface data storage part 284 generates the second through fifth designed surface data $D_{S2}$-$D_{S5}$ indicating the second through fifth designed surfaces S2-S5 linked to the first designed surface S1.

Specifically, the designed surface data storage part 284 sets the second designed surface S2 connected to the vehicle main body 1 side end portion of the first designed surface S1, and the third designed surface S3 further linked to the vehicle main body 1 side end portion of the second designed surface S2. Further, the designed surface data storage part 284 sets the fourth designed surface S4 linked to the opposite side of the vehicle main body 1 end portion of the first designed surface S1, and the fifth designed surface S5 further linked to the opposite side of the vehicle main body 1 end portion of the fourth designed surface S4.

Note that, in this embodiment, the first designed surface S1 is an example of a "superior designed surface" and the second through fifth designed surfaces S2-S5 are an example of a "plurality of subordinate designed surfaces". Further, the first designed surface data $D_{S1}$ indicating the first designed surface S1 is an example of "superior designed surface data", and the second through fifth designed surface data $D_{S2}$-$D_{S5}$ indicating the second through fifth designed surfaces S2-S5, are examples of "subordinate designed surface data".

Further, the designed surface data storage part 284, based on the first through fifth designed surface data $D_{S1}$-$D_{S5}$ is generated, generates shaped data Df indicating the shape of the first through fifth designed surfaces S1-S5.

As shown in FIG. 6, the first designed surface data $D_{S1}$ includes the coordinates data P1, the coordinates data P2, and the angle data θ1, the first designed surface S1 being prescribed by these items of information. Basically, the dimensions of the first designed surface S1 are prescribed by the coordinates data P1 and the coordinates data P2, and the gradient of the first designed surface S1 in relation to the horizontal line is prescribed by the angle data θ1.

Further, the second designed surface data $D_{S2}$ includes the coordinates data P3, and the angle data θ2, the second designed surface S2 being prescribed by these items of information. Basically, the dimensions of the second designed surface S2 are prescribed by the coordinates data P1 and the coordinates data P3, while the gradient of the second designed surface S2 in relation to the horizontal line is prescribed by the angle data θ2.

Again, the third designed surface data $D_{S3}$ includes the angle data θ3 (in the example in FIG. 6, θ3=0°, the third designed surface S3 being prescribed by this information. Basically, the gradient, in relation to the horizontal line, of the third designed surface S3, the starting point of which is the coordinate data P3, is prescribed by the angle data θ3. Note that it is suitable for the dimensions of the third designed surface S3 to not be prescribed.

Further, the fourth designed surface data $D_{S4}$ includes the coordinates data P4, and the angle data θ4. Basically, the dimensions of the fourth designed surface S4 are prescribed by the coordinates data P4 and the coordinates data P2, while the gradient of the fourth designed surface S4 in relation to the horizontal line is prescribed by the angle θ4.

Again, the fifth designed surface data $D_{S5}$ includes the angle data θ5, the fifth designed surface S5 being prescribed by this information. Basically, the gradient, in relation to the horizontal line, of the fifth designed surface S5 the starting point of which is the coordinates data P4, is prescribed by the angle data θ5. Note that it is suitable for the dimensions of the fifth designed surface S5 to not be prescribed.

The designed surface data storage part 284 sends to the working unit controller 26 the shape data Df indicating the first through fifth designed surfaces S1-S5 generated as described above. Further, the designed surface data storage part 284 updates the first through fifth designed surfaces $D_{S1}$-$D_{S5}$ and the shape data Df in conformance with the updating of the bucket position data Dp from the bucket position data generation part 282 or the updating of the prospective surfaces data $D_{S0}$ by the prospective surfaces data generation part 283.

The Configuration of the Working Unit Controller 26

Figure 7:
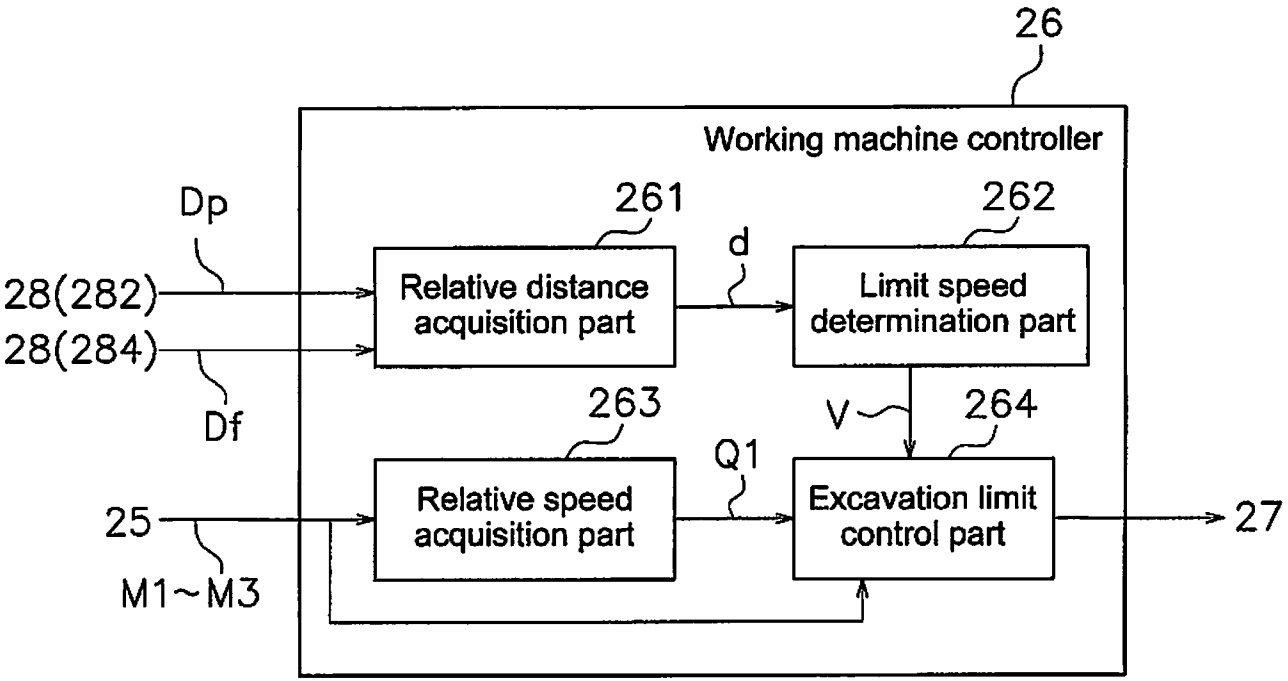
FIG. 7 is a block diagram showing the configuration of the working unit controller.
Figure 8:
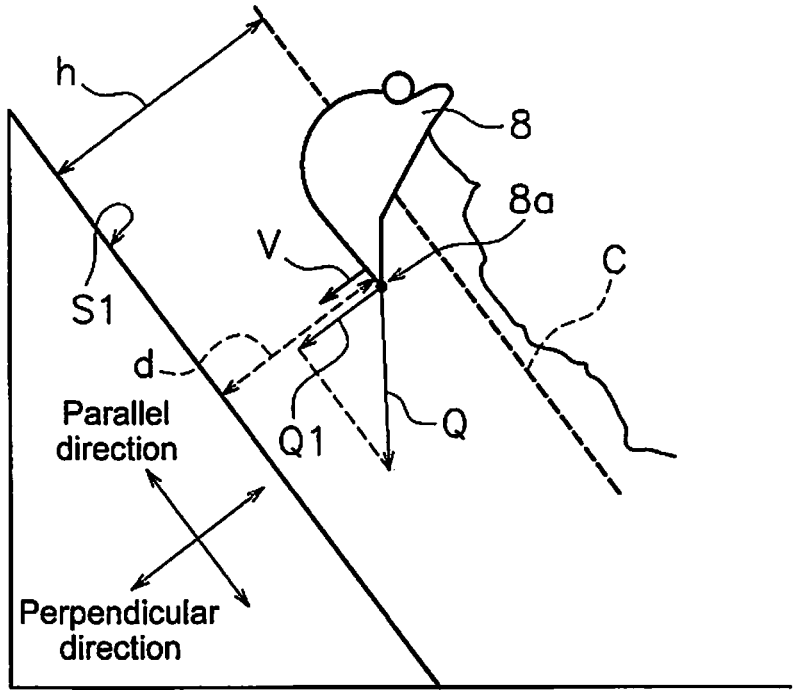
FIG. 8 is a schematic diagram showing the positional relationship between the bucket and the designed surface S.

FIG. 7 is a block diagram showing the configuration of the working unit controller 26. FIG. 8 is a schematic diagram showing the positional relationship between the bucket 8 and the designed surface S (including the first through fifth designed surfaces S1-S5).

As shown in FIG. 7, the working unit controller 26 is provided with relative distance acquisition part 261, limit speed determination part 262, relative speed acquisition part 263, and excavation limit control part 264.

1. The Relative Distance Acquisition Part 261

The relative distance acquisition part 261 acquires the bucket position data Dp from the bucket position data generation part 282 and the shape data Df for the first through fifth designed surfaces S1-S5 from the designed surface data storage part 284.

The relative distance acquisition part 261, based on the bucket position data Dp and the shape data Df, acquires the distance d between the first designed surface S1 and the cutting edge 8*a* in the direction perpendicular to the first designed surface S1. The relative distance acquisition part 261 outputs the distance d to the limit speed determination part 262.

In the example shown in FIG. 8, the distance d is less than the line distance h to the excavation limit control intervention line C, and the cutting edge 8*a* intrudes into the inner side of the excavation limit control intervention line C. It is suitable for the excavation limit control intervention line C to be set at a discretionary distance from the first designed surface S1 as deemed appropriate.

2. The Limit Speed Determination Part 262

The limit speed determination part 262 acquires the limit speed V in conformance with the distance d. The limit speed determination part 262 compares the distance d and the line distance h, and in the case of a determination that the cutting edge 8*a* exceeds the excavation limit control intervention line C, acquires the limit speed V of the relative speed Q1 in relation to the designed surface S of the cutting edge 8*a*.

Figure 9:
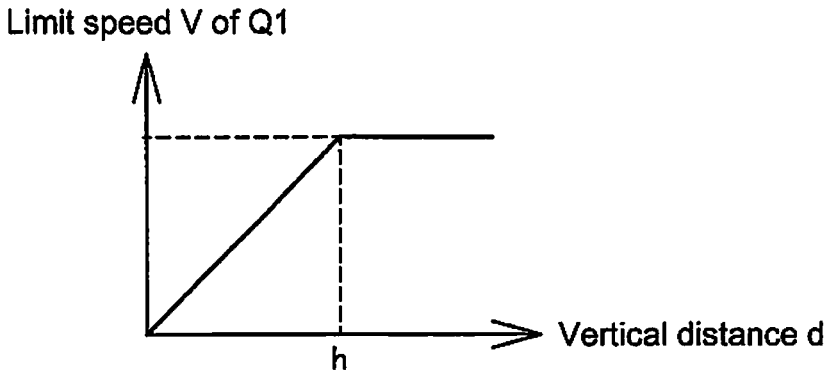
FIG. 9 is a graph showing the relationship between limit speed and distance.

Here, FIG. 9 is a graph showing the relationship between limit speed V of the relative speed Q1 and the distance d. As shown in FIG. 9, the limit speed V reaches maximum where the distance d is greater than or equal to the line distance h, and slows down to the extent that the distance d becomes less than the line distance h. Thus when the distance d is "0", the limit speed V also becomes "0". The limit speed determination part 262 outputs the limit speed V to the excavation limit control part 264.

3. The Relative Speed Acquisition Part 263

The relative speed acquisition part 263 calculates the speed Q of the cutting edge 8*a* based on the operation signals M acquired from the operating device 25. Further, the relative speed acquisition part 263, based on the speed Q, acquires the relative speed Q1 in relation to the designed surface S of the cutting edge 8*a* (refer FIG. 8).

The relative speed acquisition part 263 outputs the relative speed Q1 to the excavation limit control part 264. In the example shown in FIG. 8, the relative speed Q1 is greater than the limit speed V.

4. The Excavation Limit Control Part 264

The excavation limit control part 264 determines whether or not the relative speed Q1 in relation to the designed surface S of the cutting edge 8*a*, has exceeded the limit speed V.

In the case the excavation limit control part 264 determines that the relative speed Q1 has exceeded the limit speed V, the excavation limit control part 264 implements excavation limit control by bringing the relative speed Q1 down to the limit speed V in order to automatically adjust the position of the cutting edge 8*a* in relation to the designed surface S.

On the other hand, when the excavation limit control part 264 determines that the relative speed Q1 has not exceeded the limit speed V, the excavation limit control part 264 causes the working unit 2 to drive in accordance with the instructions of the operator by outputting the output to the proportional control valve 27 as it is with no corrections.

Actions and Effects (1) The excavation control system 200 related to this embodiment of the present invention, based on the bucket position data Dp and the prospective surfaces data $D_{S0}$, generates the first designed surface data $D_{S1}$ indicating the first designed surface S1 that is closest to the bucket 8, and the second through fifth designed surface data $D_{S2}$-$D_{S5}$ indicating the second through fifth designed surfaces S2-S5 linked to the first designed surface S1, and generates, based on the first through fifth designed surface data $D_{S1}$-$D_{S5}$, the shape data Df indicating the shape of the first through fifth designed surfaces S1-S5.

In this way, as the first designed surface S1 is set with the position of the bucket 8 as reference, the designed surface data DS (including the first through fifth designed surface data $D_{S1}$-$D_{S5}$) desired as being necessary for the excavation work can be acquired simply. Accordingly, the processing load for generating the designed surface data DS can be lowered and generation of designed surface data DS not required for the excavation work can be suppressed.

Further, as shown in FIG. 6, as the second through fifth designed surfaces S2-S5 are set with the first designed surface S1 as reference, in comparison to the case in which for example, only the second and fourth designed surfaces S2 and S4 are set with the first designed surface S1 as reference, the operator is able to control the bucket 8 not to be driven in a direction unintended by the operator.

Figure 10:
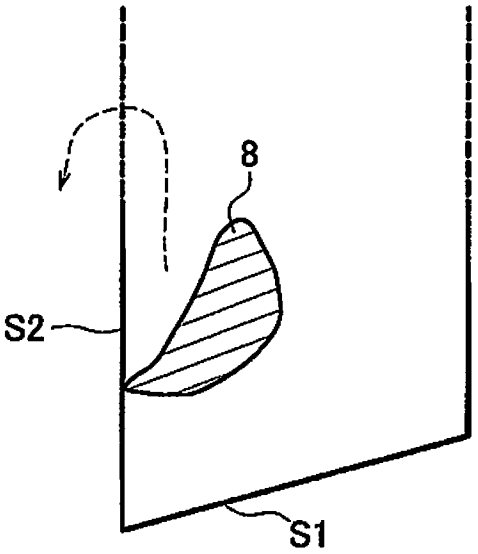
FIG. 10 is a schematic diagram explaining operation of the bucket.

Specifically, in the case in which only the second and fourth designed surfaces S2 and S4 are set, excavation operation would be as follows when the second designed surface S2 is excavated after the first designed surface S1 has been excavated. Firstly, if data for the third designed surface S3 was acquired prior to completion of excavation of the second designed surface S2, the working unit controller 26 would recognize that the second designed surface S2 would be extended, and the bucket 8 is driven upward straight out of the second designed surface S2 as shown in FIG. 10. Then there is the concern that excavation following the target shape would not be able to be performed because the bucket 8 would be guided to the third designed surface S3 at that point in time at which the data for the third designed surface S3 is acquired.

In the meantime, according to this embodiment of the present invention, because the second through fifth designed surfaces S2-S5 are set taking the first designed surface S1 as reference, when excavation moves from the first designed surface S1 to the second designed surface S2 the third designed surface has already been set, therefore the bucket 8 can be guided from the second designed surface S2 to the third designed surface S3.

(2) The designed surface data storage part 284 updates the first through fifth designed surface data $D_{S1}$-$D_{S5}$ and the shape data Df in conformance with the updating of the bucket position data Dp by the bucket position data generation part 282.

Accordingly, when for example excavation moves from the excavation of the first designed surface S1 to excavation of the second designed surface S2, the second designed surface S2 is promptly updated to the first designed surface, moreover the other designed surface linked to the third designed surface S3 is set anew. Accordingly, the phenomena of the bucket being driven in an unintended direction can be suppressed.

(3) The designed surface data storage part 284 sets the second and third designed surfaces S1, S2 so as to link sequentially to the side of the first designed surface S1 facing the vehicle main body 1, and sets the fourth and fifth designed surfaces S4 and S5 so as to link sequentially to the side of the first designed surface S1 facing the opposite side to the vehicle main body 1.

In this way, because two designed surfaces are set on either side of the first designed surface S1, when earth excavated from a trench is deposited on either the front side of the trench or the rear side of the trench, it is possible to suppress the effect of the bucket being driven in an unintended direction.

Specifically, as the first designed surface S1 is the bottom surface of the trench, the two designed surfaces S2 and S4 linked to the respective ends of the first designed surface S1 are the respective wall surfaces of the trench and the two designed surfaces are positioned in a range of movement of the working unit 2, the operator determines in the circumstances whether to deposit soil on the front side of the trench or the rear side of the trench. Thus, by setting two designed surfaces on either side of the first designed surface S1 in advance, the operation can be coordinated to the case of depositing excavation object on either the front side or the rear side of the trench.

Other Embodiments

In the foregoing, the present invention is described with respect to an embodiment thereof, however the invention is not limited to the embodiment described above. It is therefore understood that numerous modifications and variations can be devised without departing from the scope of the invention.

(A) In the above-described embodiment, the display controller 28, based on the first through fifth designed surface data $D_{S1}$-$D_{S5}$, generates the shape data Df indicating the shape of the first through fifth designed surfaces S1-S5, however this is illustrative and not restrictive. It is also suitable for the display controller 28 to generate, based on six or more designed surface data DS, shape data Df indicating the shape of six or more designed surfaces S.

In the case in which the area indicated by the designed landform data Dg is narrow, there may be cases in which only four or less designed surfaces are set. In such a case, it is suitable for the display controller 28 to generate shape data Df indicating the shape of four or less designed surfaces S, based on four or less designed surface data DS.

(B) In the above-described embodiment, the controller 28 sets the second and third designed surfaces S1, S2 so as to be sequentially linked to one side of the first designed surface S1, and sets the fourth and fifth designed surfaces S4 and S5 so as to be sequentially linked to the other side of the first designed surface S1, however this is illustrative and not restrictive. For example, it is suitable for the display controller 28 to set the second through fifth designed surfaces S2-S5 so as to be sequentially linked to one side of the first designed surface S1. Again, it is suitable for the display controller 28 to set the second through fourth designed surfaces S2-S4 so as to be sequentially linked to one side of the first designed surface S1, moreover, to set the fifth designed surface S5 so as to be sequentially linked to the other side of the first designed surface S1.

(C) In the above-described embodiment, although not mentioned specifically, it is suitable for the display controller 28 to generate shape data Df indicating a designed surface included within the range of movement of the bucket 8. This case enables a reduction in the processing load of the display controller 28, which is not required to set a designed surface S for which the bucket 8 will obviously not perform an excavation operation.

(D) In the above-described embodiment, the working unit controller 26, based on the position of the cutting edge 8*a* of bucket 8, implements a speed limit, however this is illustrative and not restrictive. The working unit controller 26 can implement a speed limit based on the arbitrary position of the bucket 8 (for example, the lowest point of the bucket 8).

(E) In the above-described embodiment, the predetermined position at which the cutting edge 8*a* stops is set as being above the designed surface S, however this is illustrative and not restrictive. It is also suitable for the predetermined position to be set as a discretionary position separate from the designed surface S to the hydraulic excavator 100 side.

(F) Although not mentioned specifically in the above-described embodiment, it is suitable for the excavation control system 200 to restrict the relative speed Q1 to the limit speed V only through reducing the rotation speed of the boom 6, and suitable to restrict the relative speed Q1 to the limit speed V by adjusting the rotation speed of not only the boom 6, but that of the arm 7 and the bucket 8.

(G) In the above-described embodiment, the excavation control system 200, based on the operation signals M acquired from the operating device 25, calculates the speed Q of the cutting edge 8*a*, however this is illustrative and not restrictive. It is also suitable for the excavation control system 200 to calculate the speed Q based on the degree of change per time unit of each of the cylinder lengths N1-N3 acquired from the first through third stroke sensors 16, 17, and 18. In this case, a more accurate calculation of the speed Q can be realized in comparison to the case of calculating speed Q based on the operation signals M.

(H) In the above-described embodiment, as shown in FIG. 9, the limit speed and the vertical distance are in a linear relationship, however this configuration is illustrative and not restrictive. The limit speed and the vertical distance can be in a relationship set as appropriate, this need not be a linear relationship, and need not pass through a point of origin.

(I) In the above-described embodiment, as shown in FIG. 6, the first designed surface data $D_{S1}$ includes the coordinates data P1, the coordinates data P2, and the angle data θ1, however it is also suitable for the angle data θ1 to not be included in the first designed surface data $D_{S1}$. In this case, it is possible for the first designed surface S1 to be prescribed by the coordinates data P1 and the coordinates data P2.

(J) In the above-described embodiment, the excavation control system 200 determines the first designed surface S1 as that surface to which the bucket 8 is closest among the prospective surfaces S0, however this is illustrative and not restrictive. The first designed surface S1 can be determined based on a position prescribed above the bucket 8. Accordingly, the excavation control system 200 may determine a surface positioned beneath the bucket 8 in the vertical direction as the first designed surface Si from the prospective surfaces S0.

The present invention can be used in a hydraulic excavator.

What is claimed is:

1. An excavation control system for a hydraulic excavator, the excavation control system comprising:

a vehicle main body, a working unit having a boom, an arm and a bucket, the boom being attached to the vehicle main body, the arm being attached to the boom, the bucket being attached to the arm;

a designed landform data storage part configured to store designed landform data indicating a target shape of an excavation object;

a bucket position data generation part configured to generate bucket position data indicating a current position of the bucket;

a designed surface data generation part configured to generate superior designed surface data and subordinate designed surface data based on the designed landform data and the bucket position data, the superior designed surface data indicating a superior designed surface corresponding to a position of the bucket, the subordinate designed surface data indicating a first subordinate designed surface linked to the superior designed surface, the designed surface data generation part being configured to generate shape data indicating shapes of the superior designed surface and the first subordinate designed surface; and an excavation limit control part configured to automatically adjust a position of the bucket in relation to the superior designed surface and the first subordinate designed surface based on the shape data and the bucket position data.

2. The excavation control system for a hydraulic excavator according to claim 1, wherein the bucket position data generation part is configured to intermittently update the bucket position data, and the designed surface data generation part is configured to update the superior designed surface data, the subordinate designed surface data and the shape data when the bucket position data generation part has updated the bucket position data.

3. The excavation control system for a hydraulic excavator according to claim 1, wherein the designed surface data generation part is configured to set a second subordinate designed surface linked to the superior designed surface, the first subordinate designed surface extends toward a vehicle main body side from the superior designed surface, and the second subordinate designed surface extends toward an opposite side of the vehicle main body side from the superior designed surface,.

4. The excavation control system for a hydraulic excavator according to claim 1, wherein the designed surface data generation part is configured to set the superior designed surface and the first subordinate designed surface based on an intersection of the designed surface data and a working plane on which the working unit moves.

5. The excavation control system for a hydraulic excavator according to claim 1, wherein each of the superior designed surface and the first subordinate designed surface is defined by coordinates data of two points.

6. The excavation control system for a hydraulic excavator according to claim 1, further comprising:

a hydraulic cylinder driving the working unit, wherein the hydraulic cylinder includes a stroke sensor configured to detect a stroke length of the hydraulic cylinder.

7. The excavation control system for a hydraulic excavator according to claim 1, wherein the vehicle main body includes a drive unit and a revolving body pivotally attached on the drive unit.

* * * * *